US005564189A

United States Patent [19]

Lee

[11] Patent Number: 5,564,189

[45] Date of Patent: Oct. 15, 1996

[54] FINGER/TOE NAIL CLIPPING AND CATCHING DEVICE

[76] Inventor: Hee U. Lee, 9237 Austin, Morton Grove, Ill. 60053

[21] Appl. No.: 498,804

[22] Filed: Jul. 6, 1995

[51] Int. Cl.[6] ..... B26B 17/00

[52] U.S. Cl. ..... 30/29; 132/25.5

[58] Field of Search ..... 30/28; 132/73.3

[56] References Cited

U.S. PATENT DOCUMENTS 860,975 7/1907 Havell ..... 30/28

FOREIGN PATENT DOCUMENTS 2042712 11/1992 Canada ..... 30/28

*Primary Examiner*—Douglas D. Watts
*Attorney, Agent, or Firm*—Sidney N. Fox

[57] ABSTRACT

A finger/toe nail clipping and catching device 20 comprises a lower arm 74 unitary with vertical side walls 46 and 48. A rear block 96 between the rear ends of the lower and upper arms 74 and 76 provides more space between said arms 74 and 76 than in the conventional nail clipper. The lower and upper arms 74 and 76 are spaced in overlying arrangement, fastened at one end 82 and terminating in spaced facing jaw formations 45 and 47. The jaw formations 45 and 47 comprise upper and lower concave center blade sections 56 and 50 and upper and lower side blade sections 55 and 57 and 52 and 54 that terminate in sharpened cutting edges. When the blade sections are engaged in "cutting" position, the interior chamber of the device 20 is completely enclosed by the interior facing surfaces of the arms 74 and 76, side walls 46 and 48, and blade sections. The invention 20 eliminates the deflection and obstruction problems caused by the conventional mounting pin by providing other mounting means for the actuating lever. The upper edges of the side walls 46 and 48 proximate the jaw formations 45 and 47 include passage means 66 and 69 to receive projection means 40 and 42 on the actuating lever 22. The actuating lever 22 comprises an elongate bar section 23 with side "wings" 26 and 28, said side wings 26 and 28 connected by a crossbar piece 38. Protruding ends 40 and 42 on the crossbar 38 are seated within passage means 66 and 69 in the side walls 46 and 48, mounting the actuating lever without the conventional mounting pin. The crossbar 38 has a elongate middle section 44 that serves as positioning means for the actuating lever 22. The side walls 46 and 48 have notches 60 and 49 that allow portions of the actuating lever to extend the level of the upper longitudinal edges of said side walls 46 and 48. Disposal means include a disposal hatch 72 fastened to the undersurface of the lower arm 74 by a rivet 82. The disposal hatch 72 may be swung sideways about the rivet 82 to reveal the opening 70 in the lower arm 74 to release accumulated clippings in a controlled manner. An angled deflecting edge 78 on the rear block 96 deflects nail clippings, providing more controlled means of disposal.

22 Claims, 4 Drawing Sheets

FINGER/TOE NAIL CLIPPING AND CATCHING DEVICE

BACKGROUND—FIELD OF THE INVENTION

The present invention relates in general to a finger/toe nail clipping and catching device, and more specifically, the present invention relates to a device that prevents nail clippings from scattering during use of the finger/toe nail clipping and catching device and offers an effective means of catching and disposing of the accumulated nail clippings.

BACKGROUND—PRIOR ART

The conventional finger/toe nail clipper devices generally are made up of a pair of elongate arms arranged overlying and co-extensive. The upper arm has limited resilience while the lower arm is rigid. The longitudinal sides are generally open. The rear ends of the arms are secured. The front ends of the arms terminate in jaw formations, each arm terminating in cutting edges spaced apart slightly. The actuating lever is provided coupled to mounting means proximate the jaw formations.

The conventional mounting means of the actuating lever consists of a mounting pin having a head at one end and a passage at the other end. Each arm has a hole adjacent to the jaw area. These holes are aligned. The mounting pin passes through the aligned holes. The mounting pin, when conventionally installed, partially blocks the way between the jaws of the clipper, which limits the entry of the finger/toe nail. Also, the mounting pin obstructs the flow of the nail clippings toward the interior area of the clipper, resulting in the uncontrolled dispersal of finger/toe nail clippings common to the use of the conventional finger/toe nail clipper device.

While prior art has attempted to address these results through various proposed structures, none of the proposed structures have been totally successful in controlling the scattering of finger/toe nail clippings. Also, the removal of clippings from the storage areas of the prior art finger/toe nail clipper is difficult.

In order to provide background information so that the invention may be completely understood and appreciated in its proper context, reference is made to a number of prior art patents as follows:

U.S. Pat. Nos. 5,072,511; 4,984,366; 4,996,771; 5,131,146; 4,419,134; 4,574,475; and 5,261,160.

The Ro U.S. Pat. No. 5,072,511 discloses an attempt to deal with these difficulties. The structure involves a recess formed in the side walls to facilitate controlled catching and discharge of the clippings. While the structure does contain many clippings within the chamber formed by the side walls, there are open slots between the side walls and jaw formations that permit escape of some of the clippings that have rebounded from the interior surfaces of the jaws and the mounting pin, leaving a retrieval problem which was sought to be avoided.

U.S. Pat. No. 4,984,366 demonstrates a slip-on device whereby a tubular element is fitted onto the conventional clipper. However, the tube does not extend to the mouth of the clipper, still allowing escape of nail clippings deflected from the mounting pin and the interior of the blades out of the side slots.

The Williams U.S. Pat. No. 4,996,771 shows a clipper with a retainer and catching mechanism that catches nail clippings in the forward position and empties the clippings when in the rearward position. Random nail clippings may still deflect from the mounting pin.

The Leininger U.S. Pat No. 5,131,146 exhibits a receptacle that has a rear sleeve which receives the rear pan of the finger/toe nail clipper as well as a front shield that receives the front portion of the finger/toe nail clipper and accommodates the nail clippings resulting from use of the clipper device. The front shield is attached to the rear sleeve by a "live" hinge that allows the front sleeve to be pulled away from the body of the clipper device about the hinge, enabling release of the clippings collected within the interior of the device. The interior side walls of the front shield engage to the lower arm of the clipper device. While the Leininger attachment may reduce the amount of scattered clippings, there is still a problem of uncontrolled dispersal with a portion of the clippings since they may, again, deflect from the mounting pin and out the open mouth of the cutting edges. Moreover, the Leininger shield and sleeve unit is a plastic molded product that fits a particular size clipper device, necessitating several sizes of the shield/sleeve unit. Also, it is likely that the plastic molded receptacle will not last an adequate useful life.

The Bumbera U.S. Pat. No. 4,419,134 evinces an attempt to eliminate the deflection problem of the mounting pin by mounting the actuating lever by means of the end of the actuating lever hooked on the band circled around the lower and upper arms of the clipper. The Bumbera structure has open side walls, which still allows the scattered escape of nail clippings. However, even if the Bumbera design had side walls, the band would prevent the front portion of the clipper to be shielded, resulting in incomplete protection against scattered escape.

U.S. Pat. No. 4,574,475 to Lee presents side walls extending from the jaw area and terminating at the rear area of the device. However, the Lee structure allows for nail clippings to be caught in the narrowed rear portion of the device, resulting in difficult removal of the clippings. Also, forward opening end notches or slots in the side walls allow the passage of random nail clippings.

The Castagna U.S. Pat. No. 5,261,160 also introduces side walls to shield the length of the nail clipper. However, the conventional mounting pin still presents the problem of deflection.

Whatever the precise merits, features, and advantages of the above cited references, none of them achieves or fulfills the purposes of the present invention.

SUMMARY OF THE INVENTION

Several objects of the present invention are:

(1) to eliminate deflection of clippings off of the conventional mounting pin by providing alternate mounting means for the actuating lever;

(2) to allow greater protection against dispersal of nail clippings by complete enclosure of the interior during use;

(3) to simplify the manufacture and operation of the device;

(4) to present a single unit free from the need for separate attachment units suggested by prior art.

In accordance with the present invention, a finger/toe nail clipping and catching device comprises overlying elongate upper and lower arms with vertical side walls unitary with said elongate lower arm, said side walls formed along the longitudinal edges of said elongate upper and lower arms to shield the area between said arms along the continuous length of the device. Said elongate upper arm is of limited resilience and is tightly secured to said elongate lower arm at the rear of the device by a rivet and spot welding. Said rivet secures said upper arm to the upper surface of a rear block while said rivet secures said lower arm to the lower surface of said rear block. Said rear block provides greater interior space between said upper and lower arms than in the conventional nail clipper. Preferably, a disposal hatch on the undersurface of said lower arm will cover an opening in said lower arm proximate the rear of the device, said disposal hatch mounted to the device by the same rivet fastening said upper and lower arms. Said disposal hatch swings sideways about said rivet to expose said hole in said lower arm. An angled deflecting edge on said rear block is positioned along the edge of said opening and deflects nail clippings. Nail clippings in the rear of such a device would deflect off of the surface of said deflector, preventing clippings from being caught at the rear end of the device. The upper and lower arms terminate in the front area of the device in spaced and facing jaw formations, said jaw formations having concave center blade sections and side blade sections engaged between said center blade sections and the beginnings of said side walls, said side blade sections serving as movable slots, said center and side blade sections with terminal cutting edges, said arms and side walls completely enclosing the interior chamber when the blade sections are engaged in the "cutting" position. Means mounting said actuating lever will enable rotational pivoting of said actuating lever. Preferably, said actuating lever comprises an elongate bar section with side "wings." A crossbar piece connects said wings, said crossbar mounted to said side walls, enabling said actuating lever to rotate back and forth from the active position above the device to the inactive position below the device. Said crossbar comprises an elongate middle section with protruding ends, said protruding ends riding in sockets in said side walls, mounting said actuating lever to said side walls.

LIST OF REFERENCE NUMERALS

Figure 2:
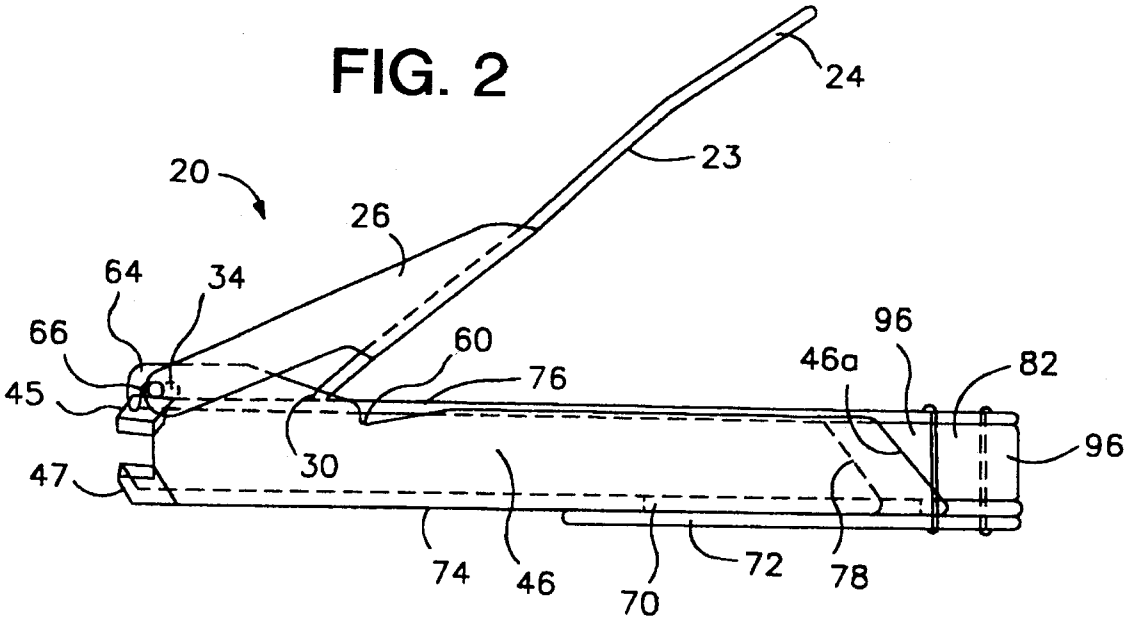
FIG. 2 is a side view of the preferred finger/toe nail clipping and catching device portrayed in FIG. 1 with the actuating lever in active position.

20 preferred finger/toe nail clipping and catching device
22 actuating lever
23 elongate bar section of actuating lever 22
**23*a* shoulder of elongate bar section 23**
**23*b* shoulder of elongate bar section 23**
24 grasping end of actuating lever 22
26 side wing of actuating lever 22
**26*b* mounting end of side wing 26**
27 longitudinal edge of elongate piece 23 where side wing 26 extends vertically
28 side wing of actuating lever 22
**28*b* mounting end of side wing 28**
29 longitudinal edge of elongate piece 23 where side wing 28 extends vertically
30 heel formation of actuating lever 22
34 slot in side wing 26
36 slot in side wing 28
38 crossbar
40 protruding end of crossbar 38
42 protruding end of crossbar 38
44 middle section of crossbar 38
**44*a* front longitudinal edge of middle section 44**
**44*b* rear longitudinal edge of middle section 44**
45 upper jaw formation
46 side wall
**46*a* rear end of side wall 46**
47 lower jaw formation
48 side wall
**48*a* rear end of side wall 48**
49 notch in side wall 48
50 lower concave blade section
51 lower center jaw formation
52 lower angular side blade section
53 upper center jaw formation
54 lower angular side blade section
55 upper angular side blade section
56 upper concave center blade section
57 upper angular side blade section
58 dip in side wall 46
59 dip in side wall 48
60 notch in side wall 46
63 flat section of side wall 46
64 hook in side wall 46
65 flat section of side wall 48
66 socket/slot in side wall 46
68 hook in side wall 48
69 socket/slot in side wall 48
70 disposal opening in lower arm 74
72 disposal hatch
74 lower arm
76 upper arm
78 angled deflecting edge of rear block 96
80 edge of opening 70
82 rivet
84 modified upper jaw formation
86 upper blade section
88 terminal cutting edge of upper blade section 86
90 modified lower jaw formation
92 lower blade section
94 terminal cutting edge of lower blade section 92
96 rear block

DESCRIPTION OF THE PREFERRED EMBODIMENT

The preferred embodiment of the present invention (designated by character reference 20) will now be described in connection with FIGS. 1 through 10 of the drawing.

The finger/toe nail clipping and catching device 20 has an elongate upper arm 76 and elongate lower arm 74 that are generally spaced in overlying arrangement. Said elongate arms' 74 and 76 longitudinal edges are parallel or nearly parallel. The finger/toe nail clipping and catching device 20 has vertical side walls 46 and 48 that shield portions of the open longitudinal sides of said overlying upper arm 76 and lower arm 74 until said side walls terminate at the rear of the device 20 by tapering down at 46*a* and 48*a*. Said lower arm 74 is unitary with said vertical side walls 46 and 48 along the lower longitudinal edges of said side walls 46 and. 48.

The device 20 has a rear block 96 that provides greater interior space between said arms 74 and 76 than in the conventional nail clipper device. Said rear block 96 is trapezoidal shaped with one angled side forming the deflector 78. The rear end of said elongate upper arm 76 is highly secured to said rear block 96 and the rear end of said lower arm 74 by a rivet 82 and spot welding. Said rivet 82 fastens said upper arm 76 to the upper surface of said rear block 96 and the lower arm 74 to the lower surface of said rear block 96. Said rivet 82 also fastens the disposal hatch 72 to the lower surface of said lower arm 74.

Figure 9:
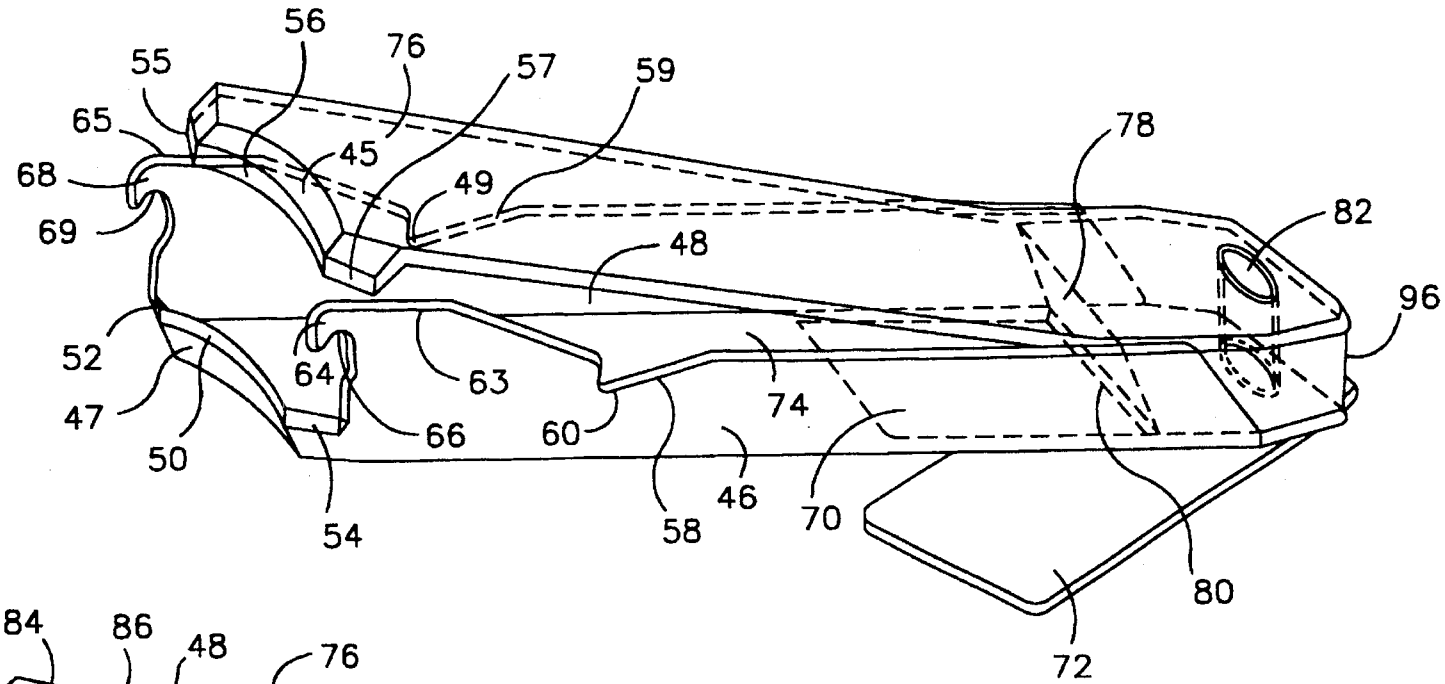
FIG. 9 is a perspective view of the body of the device (without the actuating lever and with the disposal hatch extended sideways).
Figure 10:
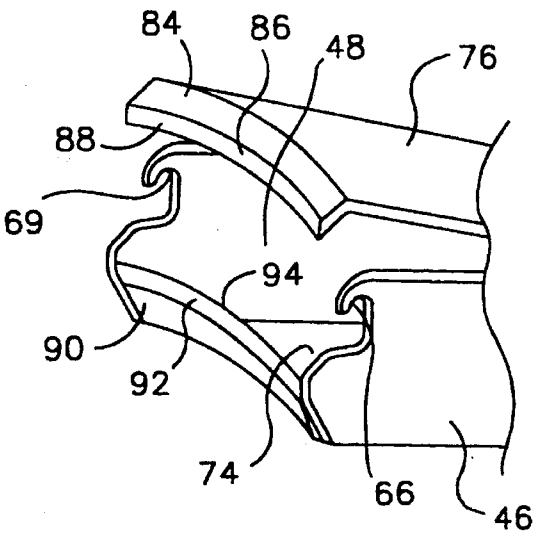
FIG. 10 is a fragmentary perspective view of the modified jaw area of the device.

Refer now to FIG. 9. The opposite ends of said elongate upper arm 76 and said elongate lower arm 74 terminate in spaced facing upper 45 and lower 47 jaw formations. Preferably, said jaw formations 45 and 47 have upper and lower concave center blade sections 56 and 50 and upper and lower angular side blade sections 55 and 57 and 52 and 54 on either side of said concave center blade sections 50 and 56, as depicted in FIG. 9. Refer now to FIG. 10. Alternatively, the jaw formations 84 and 90 have upper and lower concave blade sections 86 and 92 that terminate in sharpened cutting edges 88 and 94, as depicted in FIG. 10. Said lower concave blade section 92 would be unitary with said lower arm 74 and portions of said side walls 46 and 48. Said concave blade sections 86 and 92 would extend from one side wall 46 to the other side wall 48 and would be unusually wide (greater than ⅝ inches).

Said side walls 46 and 48 have upper longitudinal edges that dip at 58 and 59 to form notches 60 and 49 in the upper longitudinal edges of said side walls 46 and 48. Said notches 60 and 49 allow portions of the actuating lever 22 to extend below the uppermost point of the longitudinal edges of said side walls 46 and 48. Said upper longitudinal edges then extend upward diagonally and then flatten out at 63 and 65. Proximate said jaw formations 45 and 47, said upper longitudinal edges of each of said side walls 46 and 48 terminate in a hook-like formation 64 and 68 that forms a socket or slot 66 and 69, passage means for mounting the actuating lever 22.

The present invention does not have the mounting pin found in the conventional finger/toe nail clipper. The lack of a mounting pin eliminates problems with the conventional clipper. The lack of a mounting pin means that (1) there is no structure to obstruct the smooth entry of various-sized finger/toe nails between the jaw formations and (2) there is no structure in the path of the clippings that could deflect said clippings to the exterior of the device 20. Thus, in the present invention, there is no mounting pin, and other mounting means for the actuating lever are proposed.

Figure 7:
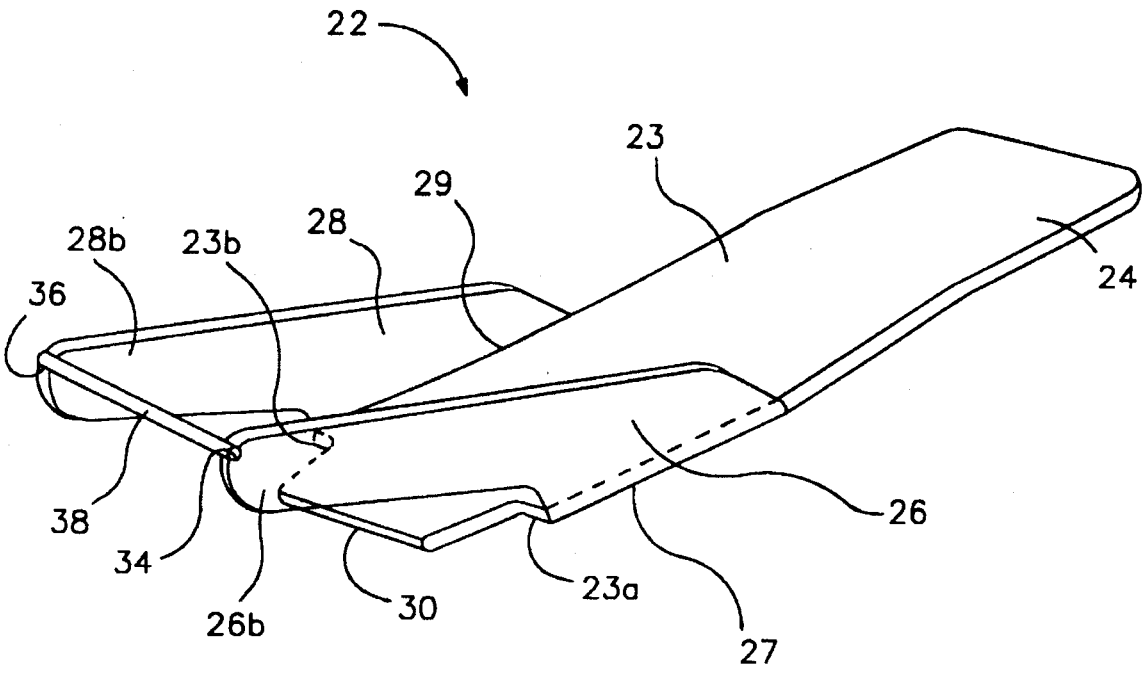
FIG. 7 is a perspective view of the actuating lever.

Refer now to FIG. 7, which represents the preferred actuating lever designated by character reference 22. Said actuating lever 22 comprises an elongate bar section 23, side wings 26 and 28, and a crossbar designated by character reference 38. One end of said elongate bar section 23 forms the grasping end 24 while the opposite end of said elongate bar section 23 forms a heel formation 30 that serves as cam means for said actuating lever 22. Said side wings 26 and 28 extend vertically from portions of the longitudinal edges of said elongate bar section 23 proximate said heel formation 30. Said side wings 26 and 28 are parallel to each other. Said side wings 26 and 28 extend vertically from portions of the longitudinal edges of the elongate bar section 23 diagonally and terminate in rounded mounting ends 26*b* and 28*b*, said mounting ends 26*b* and 28*b* with aligned slots 34 and 36 in which protruding ends 40 and 42 of said crossbar 38 sits. Said elongate bar section 23 indents to form shoulders 32.

Figure 8:
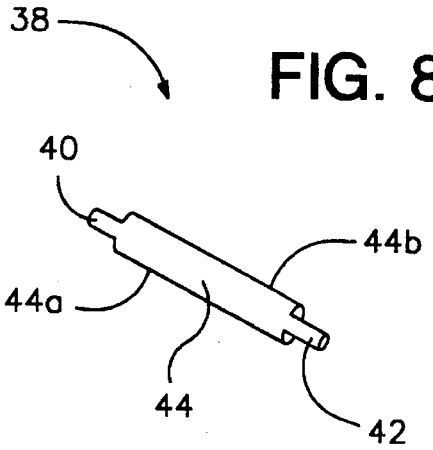
FIG. 8 is a blown-up perspective view of the crossbar.

Refer now to FIGS. 7 and 8. Said crossbar 38 has a flat, elongate middle section 44 and opposite protruding ends 40 and 42. Said elongate middle section 44 has a front 44*a* and rear 44*b* longitudinal edge. Said protruding ends 40 and 42 ride within said sockets 66 and 69 formed by said side walls 46 and 48, enabling the actuating lever 22 to be mounted to the finger/toe nail clipping and catching device 20.

When the actuating lever 22 is in its active position (as portrayed in FIGS. 1 and 2), the elongate bar section 23 of the actuating lever 22 slopes upward, away from the elongate upper arm 76 with the heel formation 30 against the upper surface of the upper arm 76 proximate said notches 60 and 49. During the active position, said front edge 44*a* of said elongate middle section 44 of said crossbar 38 rests against the upper surface of said upper arm 76. This keeps said actuating lever 22 from unintentional flipping back to any other position besides the active position by providing some resistance. During use of the device 20, the grasping end 24 of the actuating lever 22 is pressed toward the upper arm 76. The heel formation 30 bears against the upper surface of the upper arm 76, forcing the upper jaw formation 47 against the lower jaw formation 45 so that said jaw formations 47 and 45 engage the finger/toe nail introduced between said jaw formations 45 and 47, cutting said nail. When the device is in the process of cutting a nail, the interior chamber is completely isolated.

Figure 4:
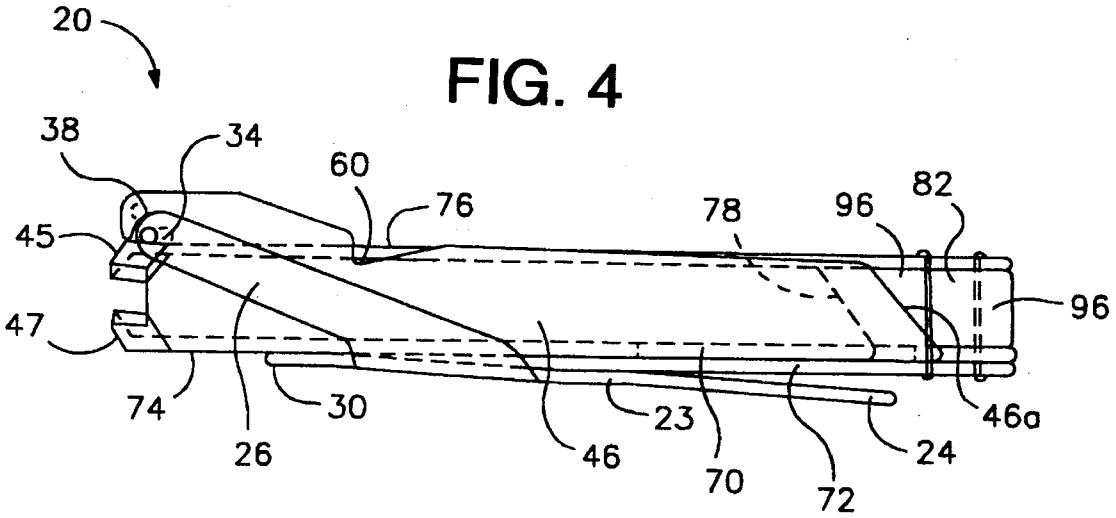
FIG. 4 is a side view of the preferred finger/toe nail clipping and catching device portrayed in FIG. 3, with the actuating lever in its inactive position.
Figure 1:
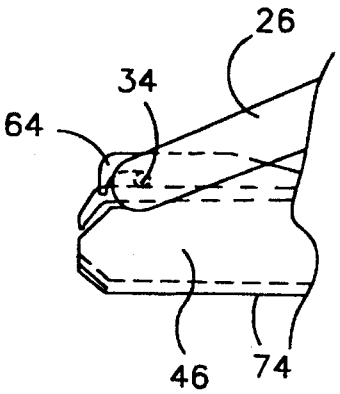
FIG. 1 is a fragmentary side view of the preferred finger/toe nail clipping and catching device in accordance with the present invention with the actuating lever in active position and the device in "cutting" position (jaws closed).
Figure 3:
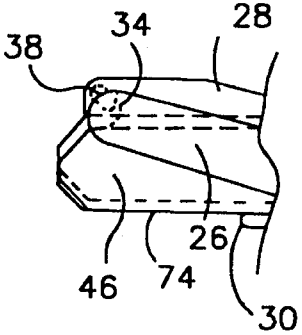
FIG. 3 is a fragmentary side view of the preferred finger/toe nail clipping and catching device with the actuating lever in inactive position.

In order for said actuating lever 22 to change from the active to the inactive position, said grasping edge 24 must be lifted upward so that said crossbar 38 rotates within said sockets 66 and 69 of said side walls 46 and 48 until the actuating lever 22 is in its inactive position below the device 20. In the inactive position, said rear edge 44*b* of said middle section 44 of said crossbar 38 rests against the upper surface of said upper arm 76, preventing said actuating lever 22 from swinging to any other position other than the inactive position by providing resistance. When the actuating lever 22 is in its inactive position (as represented in FIGS. 3 and 4), said elongate bar section 23 rests against the lower surface of said lower arm 74 and said disposal hatch 72 while said side wings rest against said side walls 46 and 48. To move said actuating lever from the inactive to active condition, said grasping edge 24 must be pulled away from the body of the device 20 so that said crossbar 38 again rotates approximately 315 degrees within said sockets 66 and 69 of said side walls 46 and 48 until said heel formation 30 rests against said upper arm 76.

Figure 6:
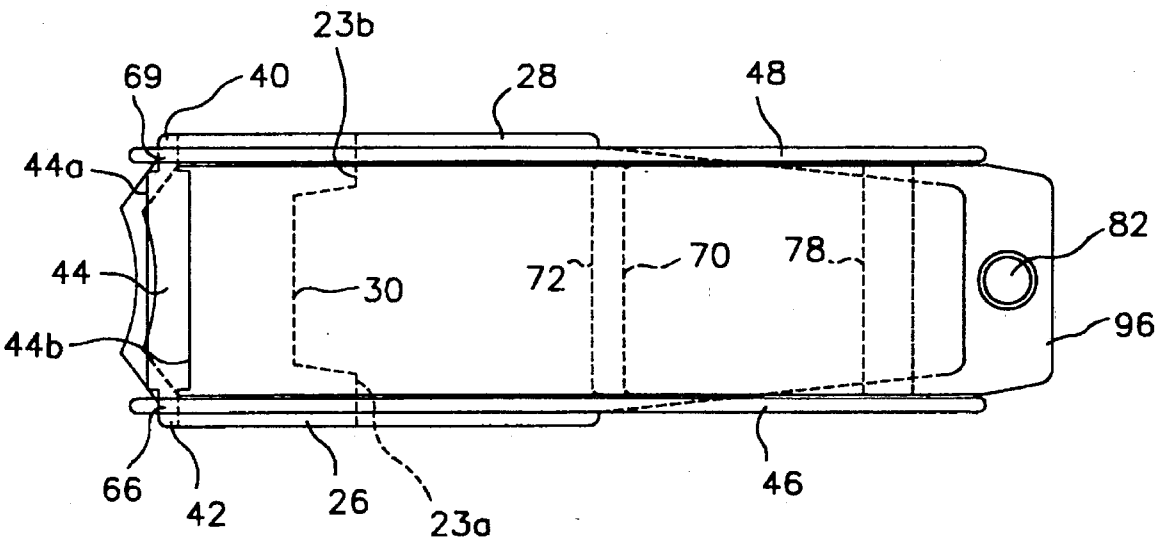
FIG. 6 is a top view of the finger/toe nail clipping and catching device depicted in FIG. 1 with phantom outlines of the actuating lever in its inactive position and the disposal means.
Figure 5:
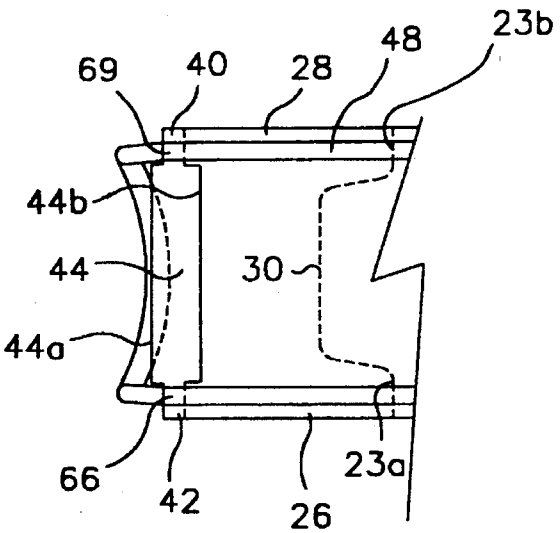
FIG. 5 is a fragmentary top view of the finger/toe nail clipping and catching device in FIG. 1.

In FIG. 9, the finger/toe nail clipping and catching device 20 is depicted with the disposal hatch 72 mounted to the undersurface of the lower arm 74 by the rivet 82 that also fastens the elongate upper arm 76 and elongate lower arm 74 together, said disposal hatch 72 extended sideways about the rivet 82 away from the body of the device 20. Refer now to FIGS. 2, 4, and 6. During the "cutting" stage, the disposal hatch 72 (depicted in phantom outline in the undersurface of the lower arm 74) is closed, covering the opening 70 where accumulated nail clippings may be released. When the user is ready to dispose of the collected nail clippings, the disposal hatch may be opened by swinging the hatch 72 to the side, allowing controlled means of discarding the accumulated nail clippings. Phantom outlines reveal the angled deflecting edge 78 of said rear block 96 that deflects nail clippings.

The foregoing descriptions of the preferred and modified embodiments of the invention have been presented for the purposes of illustration and description. They are not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A finger/toe nail clipping and catching device comprising;

an elongate upper arm of limited resilience, an elongate lower arm, each of said arms having first ends and opposite ends, said first ends being secured together with said arms spaced apart in overlying condition, jaw formations at said opposite ends terminating in blade sections having facing cutting edges, at least one of said arms having vertical side walls unitary therewith along the longitudinal edges thereof, an actuating lever arranged in bearing relationship with said upper arm forcably to effect clipping engagement of said cutting edges with a finger/toe nail introduced therebetween so as to sever said finger/toe nail forming nail clippings between said arms, disposal means for discarding said nail clippings, said actuating lever being pivotally mounted to said side walls for movement between an operative condition and a passive condition, and passage means formed in said side walls proximate said jaw formations, said actuating lever comprising an elongate bar having a grasping end and an opposite end having a leading heel formation capable of bearing relationship with one of said arms forcably to effect clipping engagement of said cutting edges, a pair of unitary side wings formed along the longitudinal edges of said elongate bar at a location spaced from said opposite end thereof, said side wings being parallel one relative the other and extending vertically angularly upward forwardly of said opposite end to define aligned terminal portions, a cross-bar having opposite protruding ends secured to said terminal portions bridging same with said protruding ends passing through said passage means for rotation therewithin enabling said actuating lever to be translated between said operating condition and said passive condition wherein said elongate bar of said actuating lever is disposed beneath said lower arm with said side wings engaged against said side walls, and positioning means maintaining the stability of said actuating lever in its assumed conditions.

2. The finger/toe nail clipping and catching device according to claim 1 in which outwardly opening aligned slot means are formed in said terminal portions of said sidewings, said protruding ends being seated secured within said slot means.

3. The finger/toe nail clipping and catching device according to claim 1 in which said positioning means comprise said cross-bar having an elongate middle section provided with a pair of opposite longitudinal edge portions, one edge portion engaging said upper arm when said actuating lever assumes its operative condition effecting resistance against unintentioned rotation therefrom, said other edge portion engaging said upper arm when said actuating lever is in its passive condition for preventing unintentioned rotation of said actuating lever from the passive condition thereof with said heel formation thereof engaged with the undersurface of said lower arm.

4. The finger/toe nail clipping and catching device according to claim 1 in which said passage means comprise slots opening in the direction of said jaw formations.

5. The finger/toe nail clipping and catching device according to claim 1 in which said passage means comprise sockets and slots opening in the direction of said jaw formations and communicating with said sockets.

6. The finger/toe nail clipping and catching device according to claim 1 in which said side wings include shoulders formed thereon adjacent the juncture thereof with said longitudinal edges of said elongate bar proximate said heel formation of said actuating lever and outwardly opening notches formed in the upper longitudinal edges of said side walls capable of receiving said shoulders when said actuating lever is urged to bring said cutting edges of said jaw formations to their cutting condition.

7. The finger/toe nail clipping and catching device according to claim 1 in which said disposal means comprise an opening formed in said lower arm and a trapezoidal-shaped block is disposed secured between said upper and lower arms, said block having an angled wall disposed for deflecting nail clippings toward said opening, said angled wall being inclined downwardly over said opening with said block positioned adjacent said opening so as to deflect nail clippings to said opening and a disposal hatch swingably secured to the exterior of said lower arm and extending over said opening for selective displacement to establish access thereto achieving disposal of said nail clippings.

8. The finger/toe nail clipping and catching device according to claim 1 in which said blade sections are concave in configuration, the lower one of said blade sections being unitary with said lower arm and portions of said side walls, said blade sections extending across the width of said upper and lower arms to allow varied nail sizes to be introduced between said blade sections and cut.

9. The finger/toe nail clipping and catching device according to claim 3 in which said passage means comprise slots opening in the direction of said jaw formations.

10. The finger/toe nail clipping and catching device according to claim 3 in which said passage means comprise sockets and slots opening in the direction of said jaw formations, said slots communicating with said sockets, said passage means being of size and configuration enabling receipt of said protruding ends therethrough.

11. The finger/toe nail clipping and catching device according to claim 1 in which said passage means comprise hook-like slots opening in the direction of said jaw formations, said slots being of size and of configuration enabling receipt therein of said protruding ends.

12. The finger/toe nail clipping and catching device according to claim 1 in which said side walls include notches formed in the upper longitudinal edges thereof, and said side wings each include shoulder formations adjacent their juncture with the longitudinal edges of said elongate bar, said notches capable of receiving said shoulders when said actuating lever is pressed downward between said side walls and against said upper arm for establishing said cutting edges of said blade sections in their cutting condition, said notches being located to prevent blockage of said shoulders by said side walls whereby to permit said cutting edges to engage.

13. The finger/toe nail clipping and catcher device according to claim 3 in which said side walls include notches formed in the upper longitudinal edges thereof, said side wings each include shoulder formations adjacent their juncture with said longitudinal edges of said elongate bar, said notches being capable of receiving said shoulders when said actuating lever is pressed downward between said side walls bearing against said upper arm for establishing said cutting edges of said blade sections in their cutting condition, said notches being located to prevent blockage of said shoulders by said side walls whereby to permit said cutting edges to engage.

14. The finger/toe clipping and catching device according to claim 1 in which said blade sections are concave in configuration, said blade sections extending across the width of said upper and lower arms and including a center blade section and angular end blade sections, said lower blade section being unitary with adjacent portions of said side walls.

15. An actuating lever for a finger/toe nail clipping and catching device of the type including upper and lower elongate upper and lower arms spaced apart in overlying condition secured together at said first ends thereof and terminating in facing jaw formations at the opposite ends, said jaw formations having blade sections, said blade sections having facing cutting edges, at least one of said upper and lower arms being of limited resilience and capable of being forcably pressed toward the other arm to place said cutting edges in cutting engagement with a finger/toe nail introduced therebetween so as to sever said finger/toe nail; said actuating lever comprising an elongate bar having a grasping end and an opposite end having a leading heel formation, said actuating lever being mounted for pivotal rotation with said heel formation in bearing relationship with the upper arm at a location proximate the jaw formation thereof, said actuating lever being pivotally rotatably movable between an operative condition and a passive condition in which said elongate bar is disposed beneath said lower arm and proximate thereto, said actuating lever having a pair of side wings formed along the longitudinal edges of said elongate bar unitary therewith at a location spaced from the opposite end thereof, said side wings being parallel one relative the other and extend vertically angularly outward forwardly of said opposite end to define aligned terminal portions, a cross-bar having opposite protruding ends arranged between said terminal portions and secured thereto, said cross-bar having an elongate middle section, said middle section having a pair of opposite longitudinal edge portions, one edge portion capable of engaging said upper arm when said actuating lever assumes its operative condition effecting resistance against unintentioned rotation therefrom, said other longitudinal edge engaging said upper arm when said actuating lever is in passive condition for preventing unintentioned rotation of said actuating lever from the passive condition thereof with the heel formation engaged with the undersurface of said lower arm.

16. The actuating lever according to claim 14 in combination with a finger/toe nail clipping and catching device which includes one of the arms thereof having vertical side walls unitary therewith along the longitudinal edges thereof, passage means formed in said side walls for receiving said protruding ends of said cross-bar therethrough between said middle section and said side wings for rotationally mounting said actuating lever.

17. In a finger/toe nail clipping and catching device of the type including an elongate upper arm of limited resilience, an elongate lower arm, each arm having a first end and an opposite end, said first ends being secured together with said arms extending spaced apart in overlying condition, jaw formations at said opposite ends terminating in blade sections having facing cutting edges, at least one of said arms having vertical side walls unitary therewith along the longitudinal edges of said side walls, an actuating lever arranged in bearing relationship with said upper arm forcably to effect clipping engagement of said cutting edges with a finger/toe nail introduced therebetween so as to sever said finger/toe nail forming nail clippings between said arms, disposal means for discarding said nail clippings and said actuating lever being pivotally mounted to said side walls for movement between an operative condition and a passive condition and passage means formed in said side walls proximate said jaw formation; the improvement comprising:

said actuating lever formed as an elongate bar having a grasping end and an opposite end, said opposite end having a leading heel formation capable of effecting a bearing relationship with said upper arm forcably to effect clipping engagement of said cutting edges, a pair of unitary side wings formed along the longitudinal edges of said elongate bar at a location spaced from said opposite end thereof, said side wings being parallel one relative the other and extending vertically upwardly forwardly of said opposite end to define aligned terminal portions, a cross-bar having opposite protruding ends secured to said terminal portions bridging same with said protruding ends passing through said passage means for rotation therewithin between said operating condition and said passive condition whereat said elongate bar of said actuating lever is disposed beneath said lower arm with said side wings engaged against the exterior surface of said side walls and positioning means maintaining the stability of said actuating lever in its assumed conditions.

18. The finger/toe nail clipping and catching device according to claim 17 in which said positioning means comprise an elongate middle section of said cross-bar having a pair of opposite longitudinal edge portions, one edge portion engaging said upper arm when said actuating lever assumes its operative condition thereby effecting resistance against unintentioned rotation therefrom, said other edge portion engaging said upper arm when said actuating lever is in its passive condition for preventing unintentioned rotation of said actuating lever from the passive condition with the said heel formation thereof engaged with the undersurface of said lower arm.

19. The finger/toe nail clipping and catching device according to claim 17 in which said side wings include shoulders formed thereon at a location adjacent the juncture thereof with said longitudinal edges of said elongate bar proximate said heel formation of said actuating lever and outwardly opening notches formed in the upper longitudinal edges of said side walls capable of receiving said shoulders when said actuating lever is urged to bring said cutting edges of said jaw formations to their cutting condition.

20. The finger/toe nail clipping and catching device according to claim 17 in which said disposal means comprise a trapezoidal shaped block secured between said upper and lower arms and an opening formed in said lower arm adjacent said block, said block having an angled wall provided with a deflecting portion directed toward said opening for deflecting nail clippings to said opening and a disposal hatch swingably secured to the exterior of said lower arm extending over said opening for selective displacement to establish access thereto achieving disposal of said nail clippings.

21. The finger/toe clipping and catching device according to claim 17 in which said blade sections are concave in configuration and extend across the width of said upper and lower arms at said opposite ends thereof and include a center blade section and angular end blade sections, said lower blade section being unitary with adjacent portions of said side walls.

22. The finger/toe nail clipping and catching device according to claim 17 in which said protruding ends of said cross-bar are passed through said passage means at a location between said cross-bar and said side wings for rotation of said actuating lever between said operative condition and said passive condition.

* * * * *